US011166567B2

(12) United States Patent
Roshberg

(10) Patent No.: US 11,166,567 B2
(45) Date of Patent: Nov. 9, 2021

(54) COVER APPARATUS AND METHODS OF ASSEMBLING SAME

(71) Applicant: Keeco, LLC, New York, NY (US)

(72) Inventor: David Stephen Roshberg, Louisville, KY (US)

(73) Assignee: Keeco, LLC, New York, NY (US)

( * ) Notice: Subject to any disclaimer, the term of this patent is extended or adjusted under 35 U.S.C. 154(b) by 620 days.

(21) Appl. No.: 15/673,319

(22) Filed: Aug. 9, 2017

(65) Prior Publication Data

US 2018/0042398 A1 Feb. 15, 2018

Related U.S. Application Data

(60) Provisional application No. 62/373,295, filed on Aug. 10, 2016.

(51) Int. Cl.

| | |
|---|---|
| ***A47C 31/10*** | (2006.01) |
| ***A47G 9/02*** | (2006.01) |
| ***A47C 27/00*** | (2006.01) |

(52) U.S. Cl.

CPC ..... *A47C 31/105* (2013.01); *A47C 27/002* (2013.01); *A47G 9/0246* (2013.01)

(58) Field of Classification Search

CPC .... A47C 31/105; A47C 27/002; A47G 9/0246
USPC ..... 5/499
See application file for complete search history.

(56) References Cited

U.S. PATENT DOCUMENTS

| | | | | | |
|---|---|---|---|---|---|
| 2,605,483 | A | * | 8/1952 | Ridenhour | A47G 9/0246 5/497 |
| 2,942,280 | A | * | 6/1960 | May, Jr. | A47G 9/0246 5/497 |
| 3,013,283 | A | * | 12/1961 | Steffinich | A47G 9/0246 5/497 |
| 3,114,156 | A | * | 12/1963 | Cobb | A47G 9/0246 5/497 |
| 3,273,175 | A | * | 9/1966 | Anderson | A47G 9/0246 5/497 |

(Continued)

OTHER PUBLICATIONS

Luke Hall, "Attached Supplemental", 2020, all pages (Year: 2020).*

(Continued)

*Primary Examiner* — Nicholas F Polito
*Assistant Examiner* — Luke Hall
(74) *Attorney, Agent, or Firm* — Duane Morris LLP; Manita Rawat

(57) ABSTRACT

A first cover segment has top and bottom edge portions that have the same first predefined length. A second cover segment is coupled to the first cover segment to enable the cover apparatus to at least partially enclose a fixture element therein. The second cover segment includes first and second side portions such that top and bottom edge portions for the second cover segment are formed. The first side portion includes a first edge piece and the second side portion includes a second edge piece that is configured to extend at an angle with respect to an endpoint of the first edge piece such that, when the first side portion and the second side portion are coupled together, the bottom edge portion of the second cover segment has a second predefined length that is different than the first predefined length.

20 Claims, 6 Drawing Sheets

(56) References Cited

U.S. PATENT DOCUMENTS 3,438,068 A * 4/1969 Anderson ..... A47G 9/0246 5/497
4,672,702 A * 6/1987 Isham ..... A47G 9/02 5/497
4,723,331 A * 2/1988 Weiss ..... A47G 9/0246 5/497
4,985,953 A * 1/1991 Seago ..... A47C 31/105 5/497
5,173,976 A 12/1992 Jubinville
5,287,574 A * 2/1994 Kardell ..... A47G 9/0246 5/497
5,636,393 A 6/1997 Zafiroglu et al.
6,532,608 B2 * 3/2003 Schreiner ..... A47G 9/0246 5/485
6,988,283 B2 1/2006 Griffin
7,240,383 B2 * 7/2007 Stewart ..... A47G 9/0246 5/497
7,293,306 B2 11/2007 Hermanczuk
7,325,263 B2 2/2008 Stribling
8,850,854 B2 * 10/2014 Morgan ..... A47C 27/063 66/170
8,990,981 B2 * 3/2015 Bensoussan ..... A47G 9/0246 5/497
8,997,280 B1 * 4/2015 Hannula ..... A47G 9/0246 5/500
2002/0088054 A1 * 7/2002 McCain ..... H04L 41/24 5/500
2008/0263774 A1 * 10/2008 Lee ..... A47C 31/001 5/691
2013/0042411 A1 * 2/2013 Vitale ..... A47G 9/0246 5/497

OTHER PUBLICATIONS

Surefit Home Decor, "Formfit Technology By Sure Fit," accessed Oct. 31, 2017 at http://www.surefit.net/category/MattressPads/. 5 pages.

* cited by examiner

COVER APPARATUS AND METHODS OF ASSEMBLING SAME

CROSS-REFERENCE TO RELATED AND CO-PENDING APPLICATION

This application claims the benefit of U.S. Provisional Patent Application Ser. No. 62/373,295 entitled "SIMPLE FIT PLUS MATTRESS PAD/TOPPER SKIRT", filed Aug. 10, 2016, the disclosure of which is incorporated herein by reference in its entirety.

BACKGROUND

The invention relates generally to covers and, more particularly, to a cover apparatus that can be used to cover various types of fixture or furniture elements, such as mattresses.

At least some known fixture or furniture elements, such as mattresses, can be used with covers that provide protection or added comfort. For example, mattress pad covers can be used with mattresses to add comfort to an existing mattress and/or to provide protection such that the can be inhibited from becoming soiled or damaged. At least some known mattress pad covers can be directly installed or coupled onto the mattress such that bed sheets are positioned on top of the mattress pad covers.

At least some known mattress pad covers include a top portion that is positioned on top of the mattress and a fabric skirt that is sewn to and extends down from the top portion of the mattress pad cover, wherein the skirt is configured to cover the side portions of the mattress. The skirt can be held in place by a piece of elastic fabric or rubber that is sewn to a bottom portion of the skirt and enables the fabric of the skirt to cinch-in and gather around the bottom surface of the matter for a substantially neater appearance and to provide grip such that the mattress pad does not decouple from the mattress. While the elastic or rubber at the bottom portion of the skirt provides grip, the skirt can still come off the mattress during normal use by a user. For example, the skirt can become loose on the corners of the mattress and come off. Moreover, depending on the fabric material that is used for the mattress pad cover, the material can become loose and cause the cover to come off the mattress during normal use by a user, such as when the user is laying and/or sleeping on the mattress.

BRIEF DESCRIPTION

The embodiments described herein provide a cover apparatus, such as a mattress pad cover, that can be used to cover a fixture element, such as a mattress, wherein the cover apparatus is configured to provide a substantial grip such that the cover apparatus is prevented from coming off the fixture element during normal use, such as when a user is positioned on the fixture element. For example, in some embodiments, a cover apparatus is provided that includes a first cover segment having a top edge portion and a bottom edge portion located a first predefined distance from the top edge portion. Each of the top edge and the bottom edge portions have the same first predefined length. A second cover segment is coupled to the bottom edge portion of the first cover segment to enable the cover apparatus to at least partially enclose a fixture element therein. The second cover segment includes a first side portion and a second side portion that is coupled to the first side portion such that a top edge portion and a bottom edge portion for the second cover segment are formed, wherein the bottom edge portion of the second cover segment is located a second predefined distance from the top edge portion of the second cover segment. The first side portion includes a first edge piece that extends from the top edge portion of the second cover segment to the bottom edge portion of the second cover segment. The second side portion includes a second edge piece that is configured to extend at an angle with respect to an endpoint of the first edge piece such that, when the first side portion and the second side portion are coupled together, the bottom edge portion of the second cover segment has a second predefined length that is different than the first predefined length.

In other embodiments, a method of assembling a cover apparatus that includes forming a first cover segment that includes a top edge portion and a bottom edge portion that is located a first predefined distance from the top edge portion, wherein each of the top edge and the bottom edge portions of the first cover segment have the same first predefined length. A second cover segment that includes a first side portion and a second side portion that is configured to couple to the first side portion such that a top edge portion and a bottom edge portion for the second cover segment are formed is formed, wherein the bottom edge portion of the second cover segment is located a second predefined distance from the top edge portion of the second cover segment when the first side portion is coupled to the second side portion. The first side portion is configured to include a first edge piece that extends from the top edge portion of the second cover segment to the bottom edge portion of the second cover segment. The second side portion is configured to include a second edge piece that is configured to extend at an angle with respect to an endpoint of the first edge piece such that, when the first side portion and the second side portion are coupled together, the bottom edge portion of the second cover segment has a second predefined length that is different than the first predefined length. The second cover segment is coupled to the bottom edge portion of the first cover segment to enable the cover apparatus to at least partially enclose a fixture element therein. The second side portion is coupled to the first side portion.

DETAILED DESCRIPTION

As described above, despite having the elastic or rubber portions at the bottom portion of at least some known covers, such as mattress pad covers, such covers can still come off the fixture element, such as a mattress, that they are covering, during normal use by a user. The embodiments described herein provide a cover apparatus, such as a mattress pad cover, that can be used to cover a fixture element, such as a mattress, wherein the cover apparatus is designed to provide a substantial grip such that the cover apparatus is prevented from coming off the fixture element that it is covering, during normal use by a user.

Figure 1:
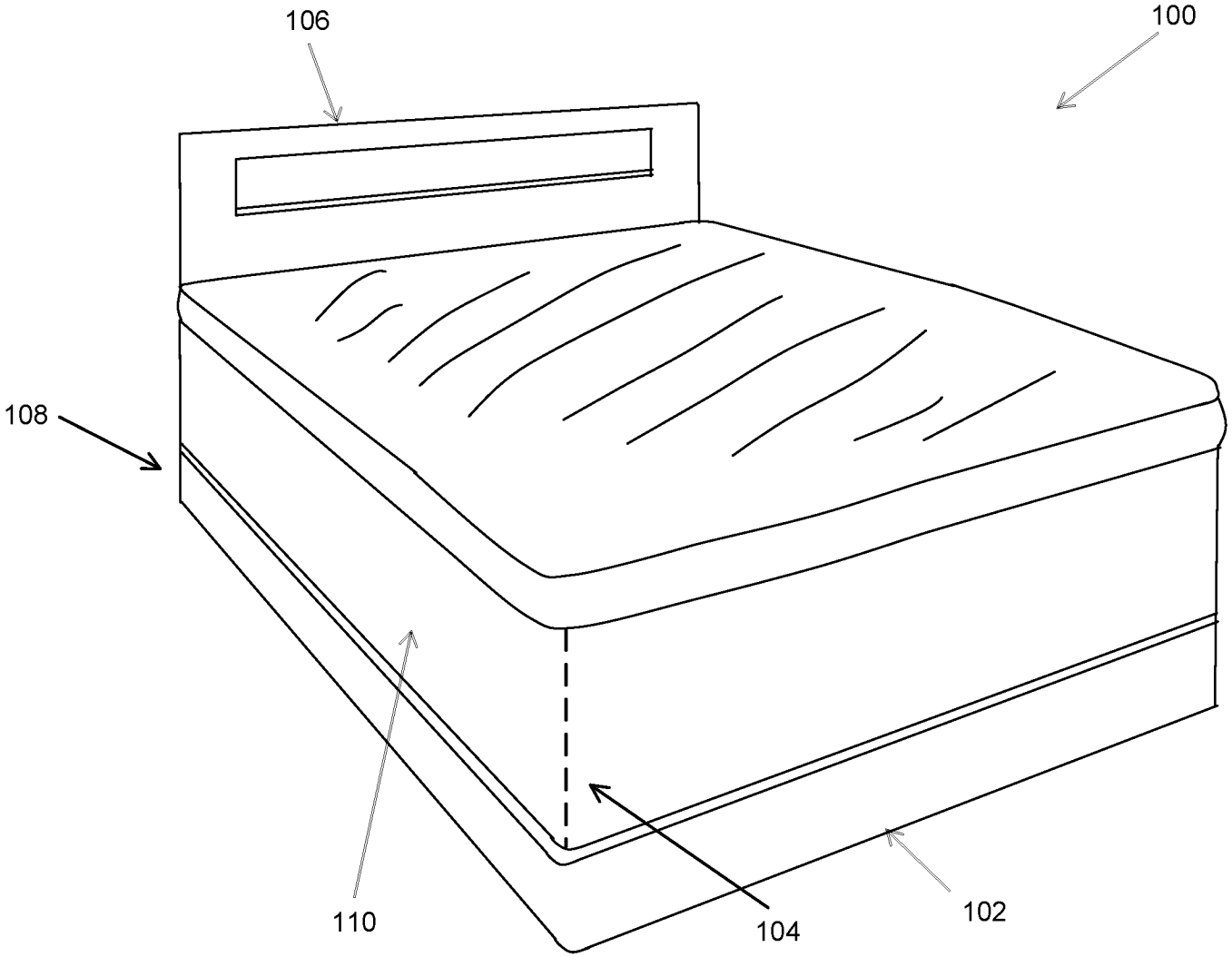
FIG. 1 is a perspective view of an exemplary embodiment of a cover apparatus that is being used with a fixture element, in accordance with some embodiments of the present disclosure.

FIG. 1 illustrates a bed assembly 100 that includes a frame 102 that is configured to support a mattress 104 and a head board 106 that is coupled to an end portion 108 of frame 102. It should be noted that, as used herein, the term "couple" is not limited to a direct mechanical, thermal, communication, and/or an electrical connection between components, but may also include an indirect mechanical, thermal, communication and/or electrical connection between multiple components.

A cover apparatus 110 is coupled to mattress 104 and substantially encloses mattress 104 such that mattress 104 is not visible to a user. Although exemplary embodiments illustrate bed assembly 100, the present disclosure is not limited to bed assemblies and one of ordinary skill in the art will appreciate that the current disclosure may be used in connection with any type of assembly or apparatus, such as any type of fixture and/or fixture element.

As described in more detail below, with respect to FIGS. 2-6, cover apparatus 110 is configured and coupled to mattress 104 in a manner that prevents cover apparatus 110 from decoupling or coming off mattress 104 during normal use by a user, such as when a user is laying and/or sleeping on mattress 104. In particular, the bottom portion (not shown in FIG. 1) of cover apparatus 110 is designed to remain coupled to mattress 104.

Figure 2:
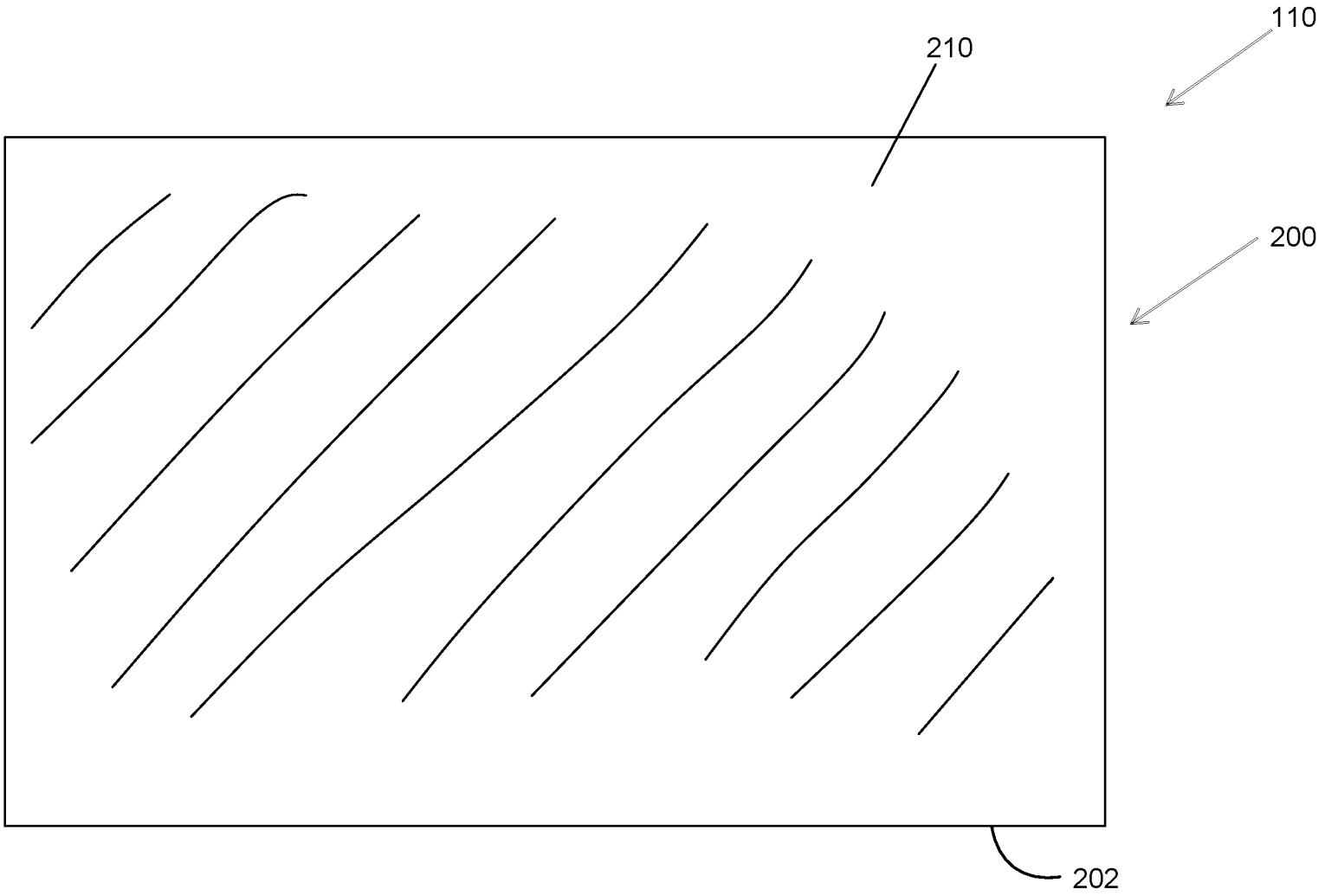
FIG. 2 is a top view of the cover apparatus shown in FIG. 1, in accordance with some embodiments of the present disclosure.
Figure 3:
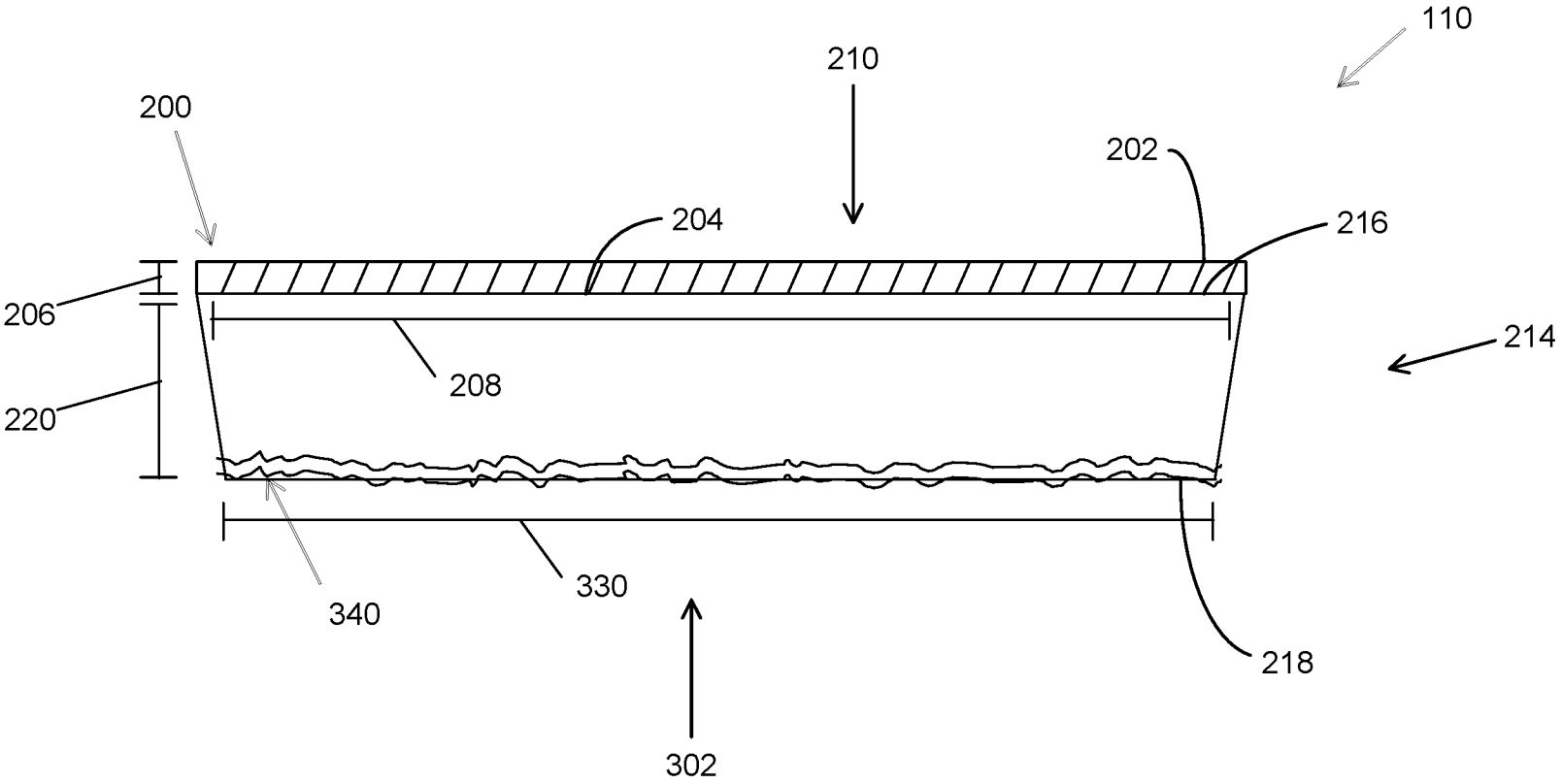
FIG. 3 is a side view of the cover apparatus shown in FIG. 1, in accordance with some embodiments of the present disclosure.

FIGS. 2-5 illustrate diagrams of cover apparatus 110 that can be used with mattress 104 (shown in FIG. 1). In some embodiments, as shown in FIGS. 2 and 3, cover apparatus 104 includes a first cover segment 200 that is configured to cover a top surface (not shown) of mattress 104. As such, first cover segment 200 can be designed and configured to fit over various mattress sizes such that first cover segment 200 is covering the entire top surface of the mattress that first cover segment 200 is being used with. In some embodiments, first cover segment 200 includes a top edge portion 202 and a bottom edge portion 204 that is located a first predefined distance 206 from top edge portion 202. In some embodiments, top edge portion 202 and bottom edge portion 204 have the same predefined length 208. Length 208 can vary depending on the size and type of mattress that is being used.

Top edge portion 202 can have an upper surface 210 that is visible to a user and bottom edge portion 204 can have an opposing lower surface that is directly adjacent to the top surface of mattress 104. As such, when cover apparatus 110 is positioned on and coupled to mattress 104, a user would be positioned on upper surface 210 of top edge portion 202 during use.

In some embodiments, first cover segment 200 is composed of a suitable fabric material. For example, first cover segment 200 can be composed of a polymer material, such as a warp knitted polyester fabric material. In other embodiments, first cover segment 200 can be composed of at least one of a polymer material (e.g., warp knitted polyester fabric material) and a synthetic fiber material (e.g., spandex material). In some embodiments, upper surface 210 of top edge portion 202 can be have a design embedded thereon. For example, upper surface 210 can be quilted.

Figure 4:
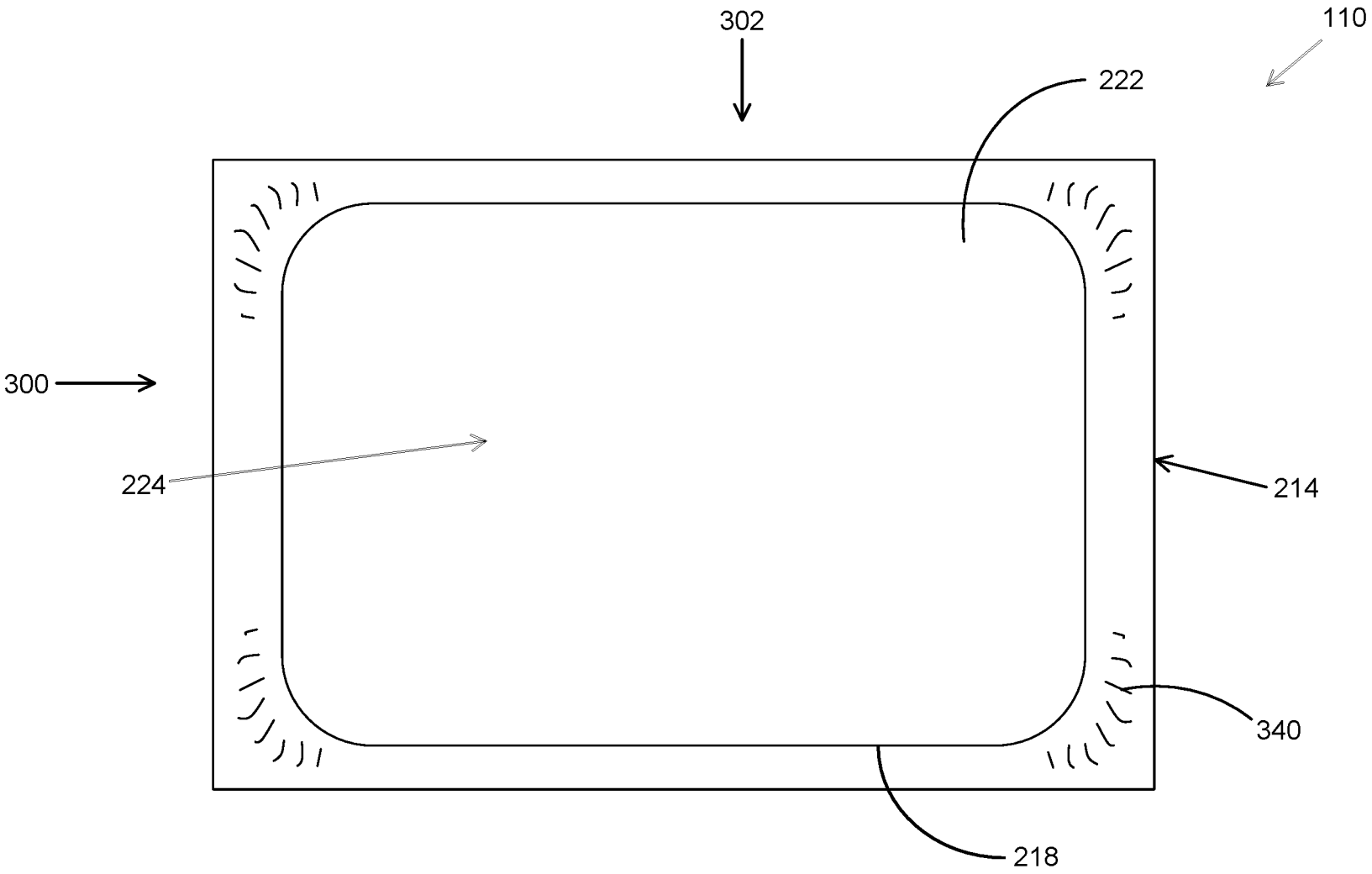
FIG. 4 is a bottom view of the cover apparatus shown in FIG. 1, in accordance with some embodiments of the present disclosure.

In some embodiments, cover apparatus 110 includes a second cover segment or skirt portion 214 that is coupled to first cover segment 200 to enable cover apparatus to substantially enclose mattress 104 therein. For example, as shown in FIGS. 3 and 4, second cover segment 214 can include a top edge portion 216 and bottom edge portion 218 positioned a second predefined distance 220 from top edge portion 216, wherein top edge portion 216 of second cover segment 214 is coupled to bottom edge portion 204 of first cover segment 200 and bottom edge portion 218 of second cover segment 214 is configured to and extend over at least a portion of a bottom surface 222 of mattress 104. In some embodiments, bottom edge portion 218 extends over at least a portion of bottom surface 222 of mattress 104 such that a middle portion 224 of mattress is not covered by second cover segment 214. In some embodiments, top edge portion 216 of second cover segment 214 has the same predefined length 208 as top edge portion 202 and bottom edge portion 204 of first cover segment 200.

Figure 5:
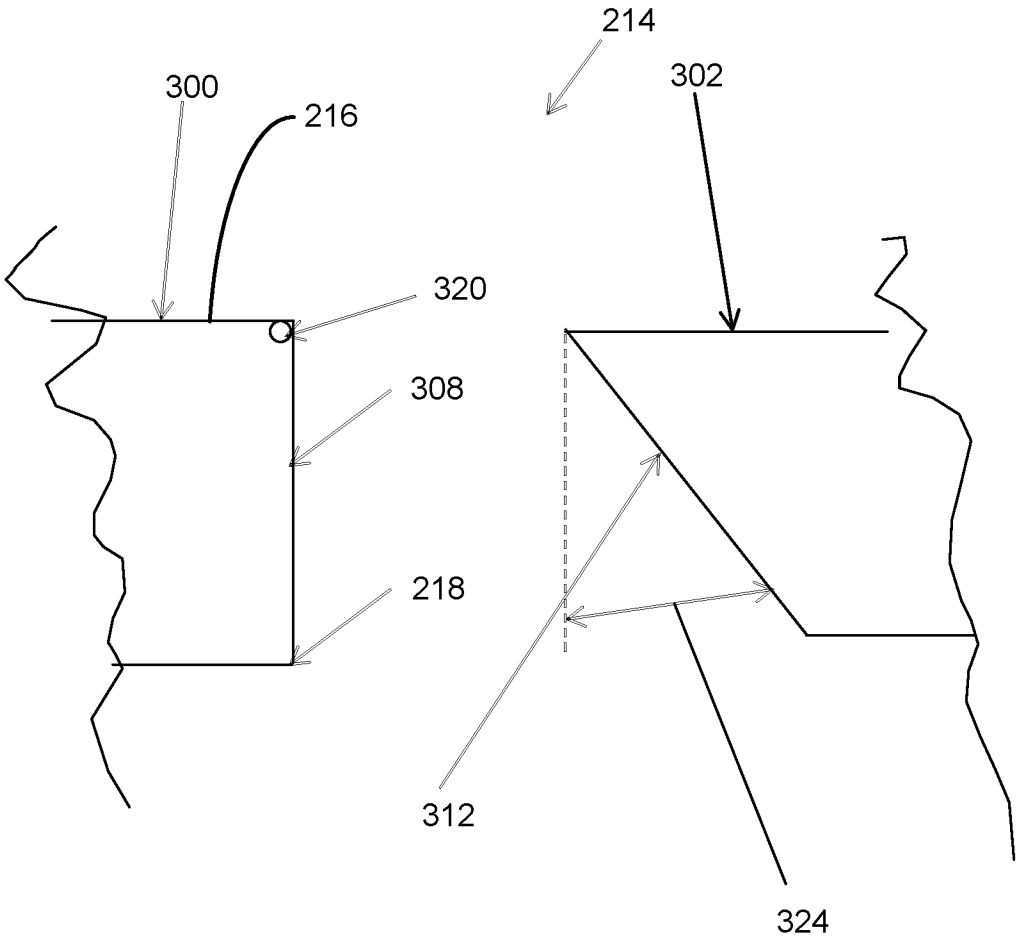
FIG. 5 is a diagram of at least two side portions, prior to being coupled together, of cover apparatus shown in FIG. 1, in accordance with some embodiments of the present disclosure.

In some embodiments, as shown in FIG. 5, second cover segment 214 includes a first side portion 300 and a second side portion 302 that are coupled together to form second cover segment 214, top edge portion 216, and bottom edge portion 218. First side portion 300 includes a first edge piece 308 that extends from top edge portion 216 to bottom edge portion 218. Second side portion 302 includes a second edge piece 312 that also extends from top edge portion 216 to bottom edge portion 218. In some embodiments, first edge piece 308 and second edge piece 312 are configured to couple to each other to form second cover segment 214.

When first edge piece 308 is positioned directly adjacent to and in contact with second edge piece 312, it can be seen that second edge piece 312 extends at an angle 324 with respect to an endpoint 320 of first edge piece 308 such that first edge piece 308 and second edge piece 312 are not parallel with respect to each other. In some embodiments, angle 324 can be approximately 20° to 40°. As such, second edge piece 312 is not perpendicular with respect to bottom edge portion 204 of first cover segment 200. Angle 324 can vary based, at least in part, on the type of fabric material that is used to compose first cover segment 200 and second cover segment 214.

Having second edge piece 312 extend at angle 324 enables bottom edge portion 218 of second cover segment 214 to have a substantially cone shape that can cinch onto mattress 104 when first edge piece 308 and second edge piece 312 are coupled together. Moreover, as shown in FIG. 3, angle 324 enables bottom edge portion 218 of second cover segment 214 to have a second predefined length 330 that is different from length 208. For example, length 330 is less than length 208. Length 330 and length 208 can vary depending on the size and type of mattress that is being used.

In some embodiments, second cover segment 214 is composed of a suitable fabric material and can be formed of the same material as first cover segment 200. For example, second cover segment 214 can be composed of a polymer material, such as a warp knitted polyester fabric material. In other embodiments, second cover segment 214 can be composed of at least one of a polymer material (e.g., warp knitted polyester fabric material) and a synthetic fiber material (e.g., spandex material).

In some embodiments, a border portion 340 can be coupled to bottom edge portion 218 of second cover segment 214, wherein border portion 340 is configured to facilitate cinching bottom portion 218 onto mattress 104. For example, border portion 340 can be composed of an elastic material. In some embodiments, the elastic material can be a rubber elastic material or a knitted elastic material. The combination of angle 324 and border portion 340 enables cover apparatus 110 to remain coupled to mattress 104 and inhibits cover apparatus 110 from being decoupled or coming off mattress 104 during normal use, such as when a user is laying or sleeping on mattress 104.

Figure 6:
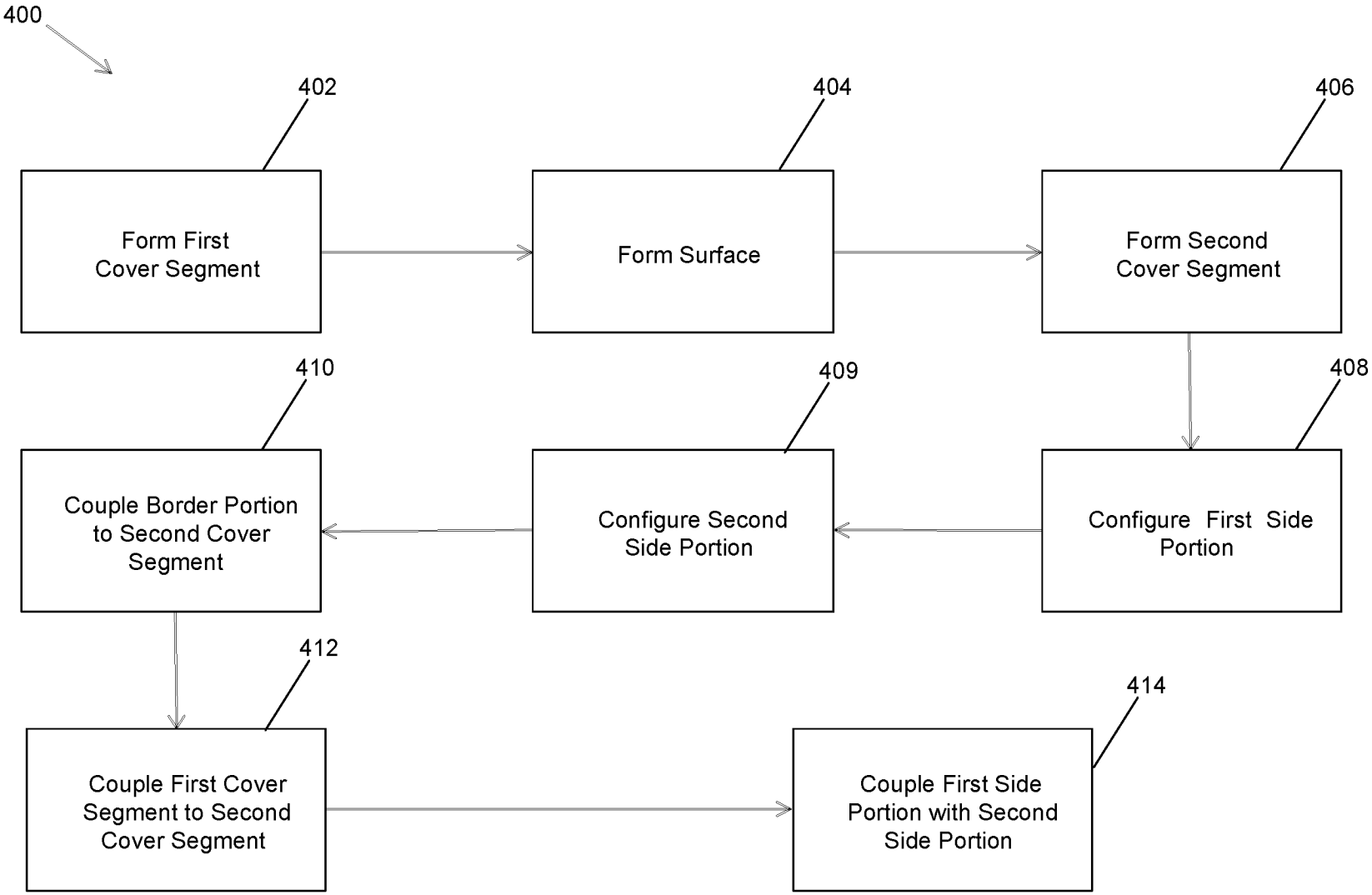
FIG. 6 is a diagram of an exemplary method of assembling the cover apparatus shown in FIG. 1, in accordance with some embodiments of the present disclosure.

FIG. 6 is a diagram 400 of an exemplary method of assembling cover apparatus 110 (shown in FIGS. 1-5). In step 402, a first cover segment, such as first cover segment 200 (shown in FIGS. 2 and 3) is formed. First cover segment 200 can be formed by cutting a suitable fabric material such that the material includes a top edge portion 202 (shown in FIGS. 2 and 3) and a bottom edge portion 204 (shown in FIGS. 2 and 3) that is located a first predefined distance 206 (shown in FIG. 3) from top edge portion 202, wherein top edge portion 202 and bottom edge portion 204 have the same predefined length 208 (shown in FIG. 3). Distance 206 and length 208 can vary depending on the size of mattress 104 (shown in FIGS. 1 and 4) that is being used.

In step 404, a surface 210 (shown in FIGS. 2 and 3) on top edge portion 202 of first cover segment 200 is formed, wherein surface 210 is visible and can be formed of a quilted fabric material.

In step 406, a second cover segment 214 (shown in FIGS. 3, 4, and 5) is formed. In some embodiments, second cover segment is formed by cutting a fabric material that includes a first side portion 300 (shown in FIG. 5) and a second side portion 302 (shown in FIG. 5) that is configured to couple to first side portion 300 such that a top edge portion 216 (shown in FIGS. 3 and 5) and a bottom edge portion 218 (shown in FIGS. 3 and 5) that is located a predefined distance 220 (shown in FIG. 3) from top edge portion 216 is formed. Distance 220 can vary depending on the type and size of mattress 104 being used. For example, if mattress 104 is a queen size mattress, then distance 220 is approximately 28 inches.

In step 408, first side portion 300 is configured to include a first edge piece 308 (shown in FIG. 5) that extends from top edge portion 216 to bottom edge portion 218, and such that first side portion 300 can couple to second side portion 302.

In step 409, second side portion 302 is configured to include a second edge piece 312 (shown in FIG. 5). For example, second side portion 302 can be cut such that second end piece 312 extends at an angle 324 (shown in FIG. 5) with respect to an endpoint 320 (shown in FIG. 5) of first edge piece 308 when first edge piece 308 is positioned directly adjacent to and in contact with second edge piece 312, such that first edge piece 308 and second edge piece 312 are not parallel with respect to each other. In some embodiments, angle 324 can be approximately 20° to 40°. As such, second edge piece 312 is not perpendicular with respect to bottom edge portion 204 of first cover segment 200. Angle 324 can vary based, at least in part, on the type of fabric material that is used to compose first cover segment 200 and second cover segment 214.

In step 410, a border portion 340 (shown in FIGS. 3 and 4) can be coupled to bottom edge portion 218 of second cover segment 214. For example, a rubber elastic band or a knitted elastic band can be sewn to bottom edge portion 218 using any suitable method and/or device. In some embodiments, the elastic can be sewn flat to bottom edge portion 218 or tunneled within the fabric of bottom edge portion 218 by creating a self-fabric folder over at bottom edge portion 219 so that the elastic is held within the fold over.

In step 412, first cover segment 200 is coupled to second cover segment 214 using any suitable method and/or device. For example, top edge portion 216 of second cover segment 214 can be sewn onto bottom edge portion 212 of first cover segment 200 using a high speed sewing machine.

In step 414, second side portion 302 is coupled to first side portion 300. For example, second edge piece 312 can be sewn to first edge piece 308 using any suitable method and/or device, such as a high speed sewing machine. In some embodiments, second edge piece 312 is sewn closed prior to being sewn to first edge piece 308. When second side portion 302 is coupled to first side portion 300, and having second edge piece 312 extend at angle 324, bottom edge portion 218 of second cover segment 214 has a substantially cone shape that can cinch onto mattress 104. Moreover, as shown in FIG. 3, angle 324 enables bottom edge portion 218 of second cover segment 214 to have a second predefined length 330 that is different from length 208. For example, length 330 is less than length 208.

Exemplary embodiments of the apparatus, systems, and methods are described above in detail. The apparatus, systems, and methods are not limited to the specific embodiments described herein, but rather, components of the apparatus, systems, and/or steps of the method may be utilized independently and separately from other components and/or steps described herein. For example, the apparatus may also be used in combination with other systems and methods, and is not limited to practice with only a system as described herein. Rather, the exemplary embodiment can be implemented and utilized in connection with many other systems.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cover apparatus comprising:

a first cover segment comprising a first top edge portion and a first bottom edge portion located a first predefined distance from said first top edge portion, wherein each of said first top edge and said first bottom edge portions of said first cover segment have the same first predefined length; and a second cover segment that is coupled to said first bottom edge portion of said first cover segment to enable said cover apparatus to at least partially enclose a furniture element therein, wherein said second cover segment comprises:

a first side portion; and a second side portion that is coupled to said first side portion such that a second top edge portion and a second bottom edge portion for said second cover segment are formed, wherein said second bottom edge portion of said second cover segment is located a second predefined distance from said second top edge portion of said second cover segment, said first side portion comprises a first edge piece that extends from said second top edge portion of said second cover segment to said second bottom edge portion of said second cover segment and said second side portion comprises a second edge piece that is configured to extend continuously from said second top edge portion of said second cover segment to said second bottom edge portion of said second cover segment at an angle that is 20° to 40° with respect to a vertical line, said vertical line being parallel to a vertical edge of the first cover segment, wherein an endpoint of said first edge piece at the second top edge portion is a vertex of the angle, and said second edge piece is configured to extend such that, when said first side portion and said second side portion are coupled together, said second bottom edge portion of said second cover segment has a second predefined length that is different than the first predefined length.

2. A cover apparatus in accordance with claim 1, wherein said first cover segment and said second cover segment are each composed of a fabric material.

3. A cover apparatus in accordance with claim 2, wherein the fabric material comprises at least one of a polymer material and a synthetic fiber material.

4. A cover apparatus in accordance with claim 1, wherein a border portion is coupled to said second bottom edge portion of said second cover segment.

5. A cover apparatus in accordance with claim 4, wherein said border portion comprises an elastic material.

6. A cover apparatus in accordance with claim 5, wherein said elastic material comprises one of a rubber elastic material or a knitted elastic material.

7. A cover apparatus in accordance with claim 1, wherein the angle depends on a fabric material used to compose said first cover segment and said second cover segment.

8. A cover apparatus in accordance with claim 1, wherein said first top edge portion of said first cover segment comprises a visible surface.

9. A cover apparatus in accordance with claim 8, wherein said visible surface is composed of a quilted fabric material.

10. A cover apparatus in accordance with claim 1, wherein the furniture element is a mattress, and the first bottom edge portion has a lower surface configured to be directly adjacent to the top surface of the mattress.

11. A method of assembling a cover apparatus, said method comprising:

forming a first cover segment that includes a first top edge portion and a first bottom edge portion located a first predefined distance from the top edge portion, wherein each of the first top edge and the first bottom edge portions of the first cover segment have the same first predefined length;

forming a second cover segment that includes a first side portion and a second side portion that is configured to couple to the first side portion such that a second top edge portion and a second bottom edge portion for the second cover segment are formed, wherein the second bottom edge portion of the second cover segment is located a second predefined distance from the second top edge portion of the second cover segment when the first side portion is coupled to the second side portion;

configure the first side portion to include a first edge piece that extends from the second top edge portion of the second cover segment to the second bottom edge portion of the second cover segment;

configure the second side portion to include a second edge piece that is configured to extend continuously from the second top edge portion of the second cover segment to the second bottom edge portion of the second cover segment at an angle that is 20° to 40° with respect to a vertical line, said vertical line being parallel to a vertical edge of the first cover segment, wherein an endpoint of the first edge piece at the second top edge portion is a vertex of the angle, and said second edge piece is configured to extend such that, when the first side portion and the second side portion are coupled together, the second bottom edge portion of the second cover segment has a second predefined length that is different than the first predefined length;

couple the second cover segment to the first bottom edge portion of the first cover segment to enable the cover apparatus to at least partially enclose a furniture element therein; and couple the second side portion to the first side portion.

12. A method in accordance with claim 11, further comprising composing the first cover segment and the second cover segment with a fabric material.

13. A method in accordance with claim 12, wherein the fabric material includes at least one of a polymer material and a synthetic fiber material.

14. A method in accordance with claim 11, further comprising coupling a border portion to the second bottom edge portion of the second cover segment.

15. A method in accordance with claim 14, wherein the border portion includes an elastic material.

16. A method in accordance with claim 15, wherein the elastic material includes one of a rubber elastic material or a knitted elastic material.

17. A method in accordance with claim 11, further comprising varying the angle based, at least in part, on a fabric material used to compose the first cover segment and the second cover segment.

18. A method in accordance with claim 11, further comprising forming a visible surface on the first top edge portion of the first cover segment.

19. A method in accordance with claim 18, further comprising composing the visible surface with a quilted fabric material.

20. A method in accordance with claim 11, wherein the furniture element is a mattress, and the first bottom edge portion has a lower surface configured to be directly adjacent to the top surface of the mattress.

* * * * *